US007156431B2

(12) United States Patent
Norgaard

(10) Patent No.: US 7,156,431 B2
(45) Date of Patent: Jan. 2, 2007

(54) WEDGE COUPLE FOR BLOCKING-UP AND FIXATION OF WINDOWS AND DOORS

(76) Inventor: Keld Norgaard, Februarvaenget 41, DK-6000 Kolding (DK)

( * ) Notice: Subject to any disclaimer, the term of this patent is extended or adjusted under 35 U.S.C. 154(b) by 568 days.

(21) Appl. No.: 10/481,412

(22) PCT Filed: Sep. 16, 2002

(86) PCT No.: PCT/DK02/00601

§ 371 (c)(1),
(2), (4) Date: Feb. 3, 2004

(87) PCT Pub. No.: WO03/033850

PCT Pub. Date: Apr. 24, 2003

(65) Prior Publication Data

US 2004/0168376 A1 Sep. 2, 2004

(30) Foreign Application Priority Data

Sep. 27, 2001 (DK) ..... 2001 01408

(51) Int. Cl.
*E05C 17/44* (2006.01)
*E04G 17/06* (2006.01)
*E06B 1/04* (2006.01)

(52) U.S. Cl. ..... 292/342; 254/104; 52/213; 52/DIG. 1

(58) Field of Classification Search ..... 52/127.12, 52/127.2, 127.5, 127.9, 745.15, 213, 126.1, 52/DIG. 1; 292/342; 49/504; 254/104; 248/651, 656, 346.01, 664, 668, 669, 188.2
See application file for complete search history.

(56) References Cited

U.S. PATENT DOCUMENTS

| | | | | | |
|---|---|---|---|---|---|
| 280,292 | A * | 6/1883 | Clason | ..... | 292/342 |
| 692,100 | A * | 1/1902 | Zirkle | ..... | 292/342 |
| 720,870 | A * | 2/1903 | Zirkle | ..... | 292/342 |
| 1,570,226 | A * | 1/1926 | Bosco | ..... | 254/104 |
| 2,524,961 | A * | 10/1950 | Cramer, Jr. | ..... | 254/104 |
| 3,171,632 | A * | 3/1965 | Jines | ..... | 254/104 |

(Continued)

FOREIGN PATENT DOCUMENTS

| | | |
|---|---|---|
| DE | 3 810144 | 10/1989 |

(Continued)

*Primary Examiner*—Naoko Slack
*Assistant Examiner*—Ryan Kwiecinski
(74) *Attorney, Agent, or Firm*—Dennison, Schultz & MacDonald

(57) ABSTRACT

Wedge couple for fixing and wedging-up of windows and doors in connection with their mounting in a wall opening, and associated with mounting shears with which the wedges can be located and tightened by means of a shearing operation with one hand. The wedge couple includes two flat wedges oriented in mutually opposite directions, each with a thick end and a thin end. The thin end of one wedge is connected to the thick end of the other wedge by means of a thin deformable plate which ensures that the two wedges are correctly arranged in relation to each other and able to be displaced only parallel towards each other in their longitudinal direction, when they are being forced together.

5 Claims, 1 Drawing Sheet

U.S. PATENT DOCUMENTS 4,135,335 A * 1/1979 Jensen ..... 52/126.1
4,192,039 A * 3/1980 Haberle et al. ..... 16/86 B
4,625,489 A * 12/1986 Bogle ..... 52/712
4,776,548 A * 10/1988 Bezenek ..... 248/188.2
5,375,329 A * 12/1994 Morikawa et al. ..... 30/134
6,018,916 A * 2/2000 Henry ..... 52/126.1
6,230,446 B1 * 5/2001 Chalich ..... 52/98
6,551,690 B1 * 4/2003 Dwinell ..... 428/156
2002/0157328 A1 * 10/2002 Holder ..... 52/126.1
2003/0145531 A1 * 8/2003 Holder ..... 52/98
2004/0168376 A1 * 9/2004 Norgaard ..... 52/127.1
2006/0022180 A1 * 2/2006 Selness ..... 254/104

FOREIGN PATENT DOCUMENTS

DE 29 619715 2/1997
DE 19 821078 11/1999

* cited by examiner

WEDGE COUPLE FOR BLOCKING-UP AND FIXATION OF WINDOWS AND DOORS

This application is a 371 of PCT/DK02/00601 filed on Sep. 16, 2002, which claims foreign priority from Danish application PA 2001 01408 filed Sep. 27, 2001.

The invention relates to a wedge couple for wedging-up and fixing of windows and doors. The wedge couple is of the kind which consists of two displaceable flat wedges, which are placed on top of each other with the thin end each in its own direction. The mutual arrangement of the two wedges is maintained in position until the mounting operation is started by connecting the thick end of one wedge to the thin end of the other. The connection between the two wedges is carried out by means of a thin deformable plate, which by its disc effect ensures that the two wedges only can be displaced in parallel directions when they are displaced towards each other during the mounting operation. The mounting operation is performed by means of a belonging pair of mounting shears, which by means of a shearing movement performed manually on the thick ends of the two wedges, whereby the wedges are displaced towards each other. The shearing movement is continued until the wedges have been displaced so much in relation to each other that the desired fixing/tightening between window frame or door frame and the wall is obtained. The wedges are made of plastic in various different sizes.

The known fixing principles make use of two separate wedges made of wood or plastic. In these cases it will always be necessary to use both hands for insertion of the two wedges in the correct position and to hold them during the tightening operation. Very often the wedges tend to turn away from each during the tightening operation, which is normally performed with various kinds of impact tools. In narrow spaces these known fitting and tightening operations can be even more difficult.

The closest known technique with a combined wedge couple is described in a German patent DE 198 28 078 in which the composed wedge couple consists of two wedges which are pulled together by means of a pulling strap fastened to one wedge and which is wound round a mandrel which passes through the other wedge and which by means of a turning tool is turned round in order to pull the two wedges together. The same patent shows a wedge arrangement consisting of a wedge couple in which the two wedges are joined at their thin ends and in which the mandrel is mounted and with which the two wedges during the turning operation are pulled round the mandrel on to a cylinder whose diameter is progressively larger during the turning operation thus resulting in a clamping effect.

It is the purpose of the invention to describe a wedge couple of the kind mentioned above, which by means of belonging mounting shears can easily be placed in the correct position and tightened with one hand, even in narrow spaces.

The wedge couple is embodied with a groove in each of the thick ends of the two wedges, which makes it possible for the wedge couple to be held in position in the mounting shears, both during the arrangement to the correct position and during the subsequent tightening.

The tightening of the two wedges is performed by the thin end of one wedge being displaced towards the thick end of the other wedge, whereby the combined thickness of the two wedges at right angles to the surfaces with which the two wedges are in contact with each other, will be larger the more the wedges are displaced in relation to each other.

The thin plate between the thick end of one wedge and the thin end of the other wedge, and vice versa, serves the purpose of maintaining the correct mutual position of the two wedges before and during the mounting operation, and at the same time it ensures that the wedges are not displaced crosswise of the desired direction of displacement or that the two wedges turn in relation to each other during the tightening operation.

The thin deformable plates which connect the two wedges in the wedge couple are attached to the thin ends of the wedges simply by extension of the of the thin ends. At the thick ends of the wedges the thin plate is via a small curve carried a short distance past the thick end and connected to it. The thickness of the small curve is embodied a little thinner than the thickness of the thin plate. This has the effect that the thin plate starts the deformation process in the curved portion by a "rolling" action in the thin plate during the tightening of the wedge couple.

The belonging mounting shears are embodied according to principles known from shears and other gripping tools, but is adapted to the double-wedge so that they can be securely gripped and held in the shears. The possible gripping width of the jaws of the shears is adapted to suit the desired mutual movement between the two wedges of the wedge couple. The two handles of the shears are made longer and embodied as two handles, where the first is used for mounting and initial tightening of the wedges and the longer for a secure tightening. The two parts of the mounting shears are made of 3 mm steel plate and assembled with a bolt, and the handles are lined with plastic, rubber or the like.

The invention is described in detail below with reference to the drawing in which.

Figure 1:
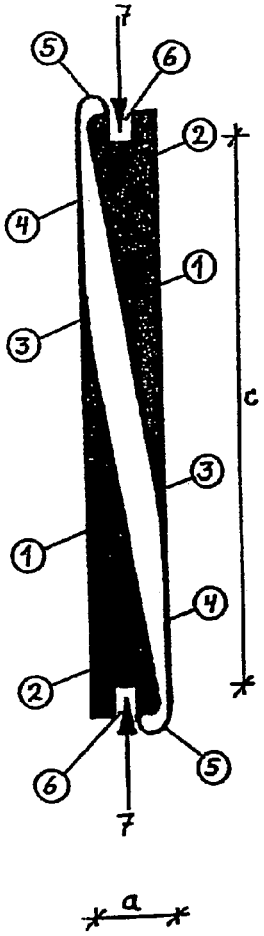
FIG. 1 shows a section in a wedge couple as it is produced. The production process can be extrusion in long sticks, which are afterwards cut into approximately 50 mm lengths, or by injection moulding in which case the wedges also are produced with a width of approximately 50 mm.

FIG. 1 is an illustration of a wedge couple as it is produced and which consists of two wedges 1, each with a thick end 2 and a thin end 3. The two wedges are interconnected by means of a thin plate 4, which at the thin edge 3 of the wedges is simply an extension of the thin end. At the thick end 2 of the wedges the thin plate 4 ends in a curved member 5, which is attached to the thick end of the wedge. When the tightening of the wedges begins, it is started with a "rolling" of the thin plate 4 in the curved member 5, as the curved member 5 is made with a slightly thinner wall thickness than the thin plate 4.

At the end of the thick end 2 there is a full-length groove 6 in which the mounting shears are held during the mounting operation and the subsequent tightening-up of the wedges. In the tightening phase the wedge couple is acted upon with a force exerted from the mounting shears, which is shown by the arrow 7.

Figure 2:
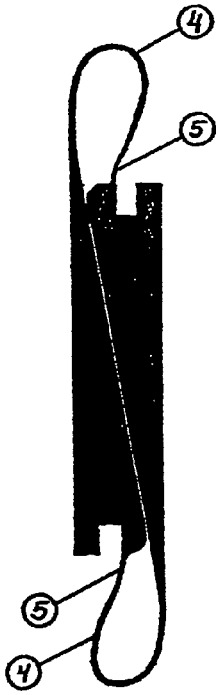
FIG. 2 shows a wedge couple after it is mounted and slightly tightened.

FIG. 2 shows a wedge couple after a slight tightening-up, and in which it can be seen that the "rolling" of the thin plate 4 has taken place as intended with a starting point in the curved portion 5 and outside the area, in which the two wedges after the tightening must lie close against each other.

Figure 3:
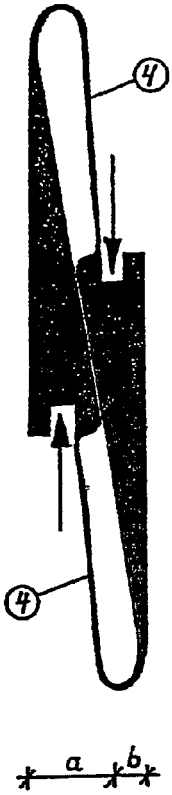
FIG. 3 shows a wedge couple after strong and maximum tightening.

FIG. 3 shows a wedge couple after a strong and maximum tightening, where the thin plate 4 is fully straightened and thus counteracts further tightening. The thickness of the wedge couple prior to the tightening is here designated a, and the thickness of the wedge couple after maximum tightening is a+b.

Figure 4:
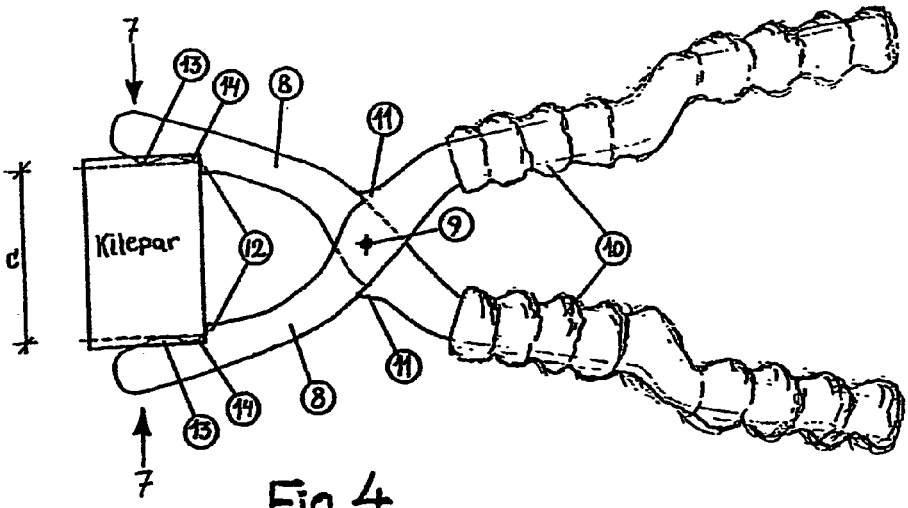
FIG. 4 shows the belonging mounting shears.

FIG. 4 shows the belonging mounting shears, which are made of two identical parts 8 in 3 mm steel plate and assembled with a bolt 9. The handles are lined with plastic, rubber, or the like. The mounting shears have two stops 11, which are bent in the plane of the shears and thereby ensure that the maximum opening of the shears is c, which corresponds to the distance between the bottom of the two grooves 6 in the wedge couple. In addition, each the shears portion carries a stop 12, which prevents the wedge couple from getting stuck in the shears during the subsequent mounting operation. When the wedge couple is gripped in the shears it is held in position by a rounded stop 13 on the shears, which at the same time is the point on the shears which imparts a force 7 on the wedge couple, when the shears are activated, and by the fact that the edge 14 of the shears at the stop 12 goes down into the groove in the wedge couple.

The invention claimed is:

1. A wedge couple and mounting shears combination comprising:

wedge couple for fixing and wedging-up of windows and doors of the kind consisting of two flat wedges (1) on top of each other with their thin ends (3) in opposite directions and which makes up a coherent unit in the way that the thick end (2) of one wedge is connected to the thin end (3) of the other wedge, and vice versa, characterized by the fact that the connection between the thick end (2) of one wedge and the thin end (3) of the other wedge, and vice versa, consists of a deformable thin plate (4) which ensures that the wedges (1) can be moved only in parallel and in the longitudinal direction of the wedges, when the wedges are being displaced towards each other, and that the wedge couple can be produced as one unit;

wherein the wedge couple is made of plastics;

and the mounting shears comprising a maximum opening for insertion of a wedge couple, and that the shears have an extended handle of which one section is used for insertion and light tightening and the other for strong tightening of the wedges.

2. Wedge couple for fixing and wedging-up of windows and doors of the kind consisting of two flat wedges (1) on top of each other with their thin ends 3 in opposite directions and which makes up a coherent unit in the way that the thick end (2) of one wedge is connected to the thin end 3 of the other wedge, and vice versa, characterised by the fact that the connection between the thick end (2) of one wedge and the thin end 3 of the other wedge, and vice versa, consists of a deformable thin plate (4) which ensures that the wedges (1) can be moved only in parallel and in the longitudinal direction of the wedges, when the wedges are being displaced towards each other, and that the wedge couple can be produced as one unit.

3. Wedge couple according to claim 2, characterised by the fact that the thin plate (4), which combines the two wedges (1) is finished with a still thinner curved portion (5) at the thick end 2 of the wedges, whereby it is achieved that the deformation of the thin plate (4) starts in the curved portion (5) and thus outside the area, where the wedges after the tightening are to lie close against each other.

4. Wedge couple according to claim 2 characterised by the fact that each of the thick ends (2) of the two wedges have a through-going groove (6), so that the wedge couple can be accommodated in the belonging mounting shears and held there while the wedge couple is given the desired position and also during the subsequent tightening operation.

5. Wedge couple according to claim 2 characterised by the fact that they are made of plastics.

* * * * *